US008544478B2

(12) United States Patent
Liao et al.

(10) Patent No.: US 8,544,478 B2
(45) Date of Patent: Oct. 1, 2013

(54) DUAL GAS AND AC ELECTRIC HAIR STYLER

(75) Inventors: Feng-Chih Liao, Taichung (TW); Yen-Chin Cheng, Taichung (TW)

(73) Assignee: Manica-Taiwan Incorporated, Taichung (TW)

( * ) Notice: Subject to any disclaimer, the term of this patent is extended or adjusted under 35 U.S.C. 154(b) by 33 days.

(21) Appl. No.: 13/243,222

(22) Filed: Sep. 23, 2011

(65) Prior Publication Data

US 2013/0074866 A1 Mar. 28, 2013

(51) Int. Cl.

| | |
|---|---|
| ***A45D 1/04*** | (2006.01) |
| ***A45D 20/08*** | (2006.01) |
| ***A45D 2/36*** | (2006.01) |
| ***A45D 4/00*** | (2006.01) |
| ***A45D 2/22*** | (2006.01) |
| ***A45D 4/06*** | (2006.01) |
| ***A45D 4/12*** | (2006.01) |
| ***H05B 1/00*** | (2006.01) |
| ***H05B 3/02*** | (2006.01) |
| ***H05B 11/00*** | (2006.01) |

(52) U.S. Cl.

USPC ..... 132/232; 132/271; 132/229; 132/227; 219/225; 219/222; 219/227; 126/408; 126/409

(58) Field of Classification Search

USPC ..... 132/232, 206, 211, 212, 118, 227, 132/229, 228, 230, 231, 233, 234, 235, 271, 132/224; 219/222, 209, 223, 225, 226, 227, 219/228, 229; 34/96, 97, 283; 392/379, 392/380, 383–385; 126/408, 409

See application file for complete search history.

(56) References Cited

U.S. PATENT DOCUMENTS

| | | | | | |
|---|---|---|---|---|---|
| 3,859,497 | A | * | 1/1975 | McNair | 219/225 |
| 4,228,343 | A | * | 10/1980 | Kanner et al. | 219/225 |
| 4,382,448 | A | * | 5/1983 | Tittert | 132/232 |
| 4,416,298 | A | * | 11/1983 | Berghammer et al. | 132/232 |
| 4,539,974 | A | * | 9/1985 | Tittert | 126/409 |
| 4,543,968 | A | * | 10/1985 | Fukunaga et al. | 132/212 |
| 4,635,382 | A | * | 1/1987 | Bourdeau | 34/97 |
| 4,641,010 | A | * | 2/1987 | Abura et al. | 219/222 |
| 4,743,735 | A | * | 5/1988 | Abura et al. | 219/222 |
| 4,815,441 | A | * | 3/1989 | Schawbel et al. | 126/409 |
| 4,917,078 | A | * | 4/1990 | Zaborowski | 126/409 |
| 5,120,933 | A | * | 6/1992 | Altamore et al. | 219/225 |
| 5,526,829 | A | * | 6/1996 | Smith | 132/229 |
| 5,857,262 | A | * | 1/1999 | Bonnema et al. | 34/97 |
| 7,913,416 | B1 | * | 3/2011 | Scieri | 34/97 |

* cited by examiner

*Primary Examiner* — Vanitha Elgart
(74) *Attorney, Agent, or Firm* — Banger Shia

(57) ABSTRACT

A dual gas and AC electric hair styler comprises: a heater, a housing, and a control member movably disposed in the housing. One end of the control member is exposed out of the housing and another end of the control member is inserted in the housing to connect a linkage device of the heater. The linkage device includes a guiding member. A gas supply and an electric power supply are selectively inserted in the housing to the heater and each have a valve which is pressed to achieve connection. The axial movement of the control member causes axial movements of the linkage device and the guiding member to affect connection of the gas and the electric power supply to the heater. The hair styler can be powered by gas or electric power, and the switching of gas and electric power supplies can be done by the control member.

9 Claims, 10 Drawing Sheets

DUAL GAS AND AC ELECTRIC HAIR STYLER

BACKGROUND OF THE INVENTION

1. Field of the Invention

The present invention relates to an electric hair styler, and more particularly to a dual gas and AC electric hair styler.

2. Description of the Prior Art

Conventional stylers generally include electric powered and gas powered. Electric powered stylers can be used in house with power supply while the gas powered stylers can be used anywhere, such as wild field where there is no power supply.

The present invention has arisen to mitigate and/or obviate the afore-described disadvantages.

SUMMARY OF THE INVENTION

The primary object of the present invention is to provide a dual gas and AC electric hair styler, which can be powered by gas or electric power, and the switching of gas and electric power supplies can easily be done by a linearly movable control member.

To achieve the above object, a dual gas and AC electric hair styler in accordance with the present invention comprises: a heater disposed in a housing, an extending direction of the housing is defined as axial direction. A control member is movably disposed in the housing in such a manner at that one end of the control member is exposed out of the housing and another end of the control member is inserted in the housing to connect a linkage device of the heater. The linkage device includes a guiding member. A gas supply and an electric power supply are selectively inserted in the housing to the heater. The gas supply and the electric power supply each have a valve which is pressed to achieve connection. The axial movement of the control member causes axial movements of the linkage device and the guiding member to affect connection of the gas supply and the electric power supply to the heater.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Referring to FIGS. 1-10, a dual gas and AC electric hair styler in accordance with a preferred embodiment of the present invention comprises a housing A in which being disposed a heater B. An extending direction of the housing A is defined as axial direction X, and the heater B is moved and controlled by a control member 40 which is movable along the X direction to connect gas supply C1 or electric power supply C2.

Figure 1:
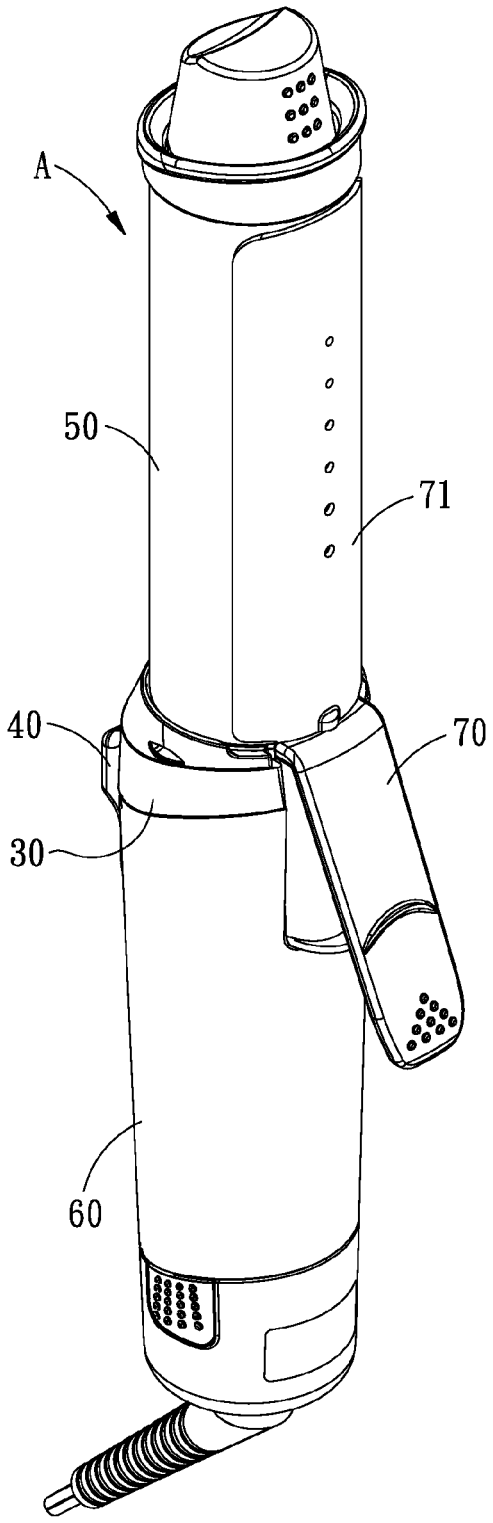
FIG. 1 shows a dual gas and AC electric hair styler in accordance with the present invention.
Figure 2:
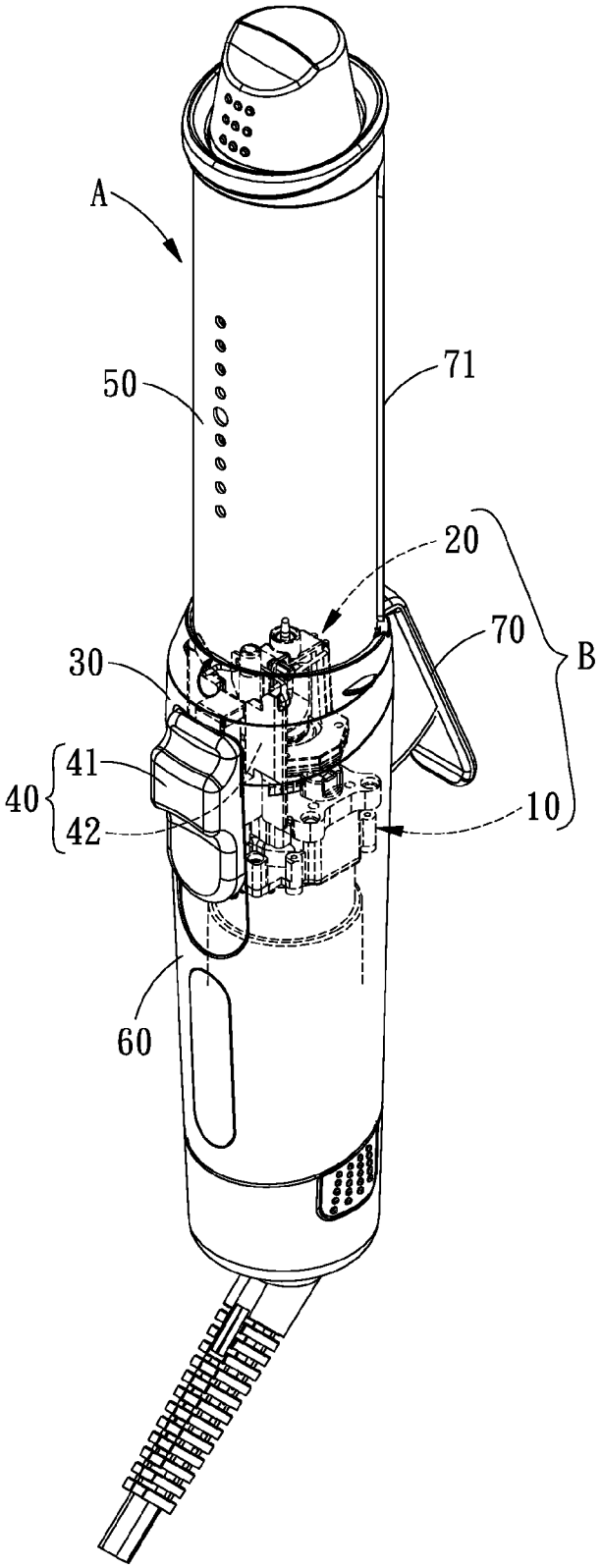
FIG. 2 is a partial perspective view of the dual gas and AC electric hair styler in accordance with the present invention.

The heater B comprises a base 10 and a linkage device 20, as shown FIG. 2.

The base 10 comprises a first connecting member 11, a middle connecting member 12 and a second connecting member 13.

The first connecting member 11 comprises a gas connecting portion 112 and two electric connecting portions 113 connected at both ends of the gas connecting portion 112 to define an assembling hole 111. At two opposite sides of the inner periphery of the gas connecting portion 112 are formed two positioning portions 114.

The middle connecting member 12 is abutted against the first connecting member 11 and formed with a connecting groove 121 in communication with the assembling hole 111 of the first connecting member 11. In the connecting groove 121 is further formed a hole 122 located corresponding to the gas connecting portion 112, and an electric connecting terminal 123 for each of the electric connecting portions 113.

The second connecting member 13 is formed at one end thereof with a connecting portion 131 which is hollow cylindrical and formed with a through hole 132. The second connecting member 13 is mounted on the middle connecting member 12 in such a manner that the connecting portion 131 is inserted through the hole 122 of the connecting groove 121 of the middle connecting member 12 into the assembling hole 111 of the first connecting member 11.

The linkage device 20 comprises a fixing member 21, an elastic pressing member 22, a guiding member 23, a spring 24, a restriction member 25 and a linking member 26.

Figure 8:
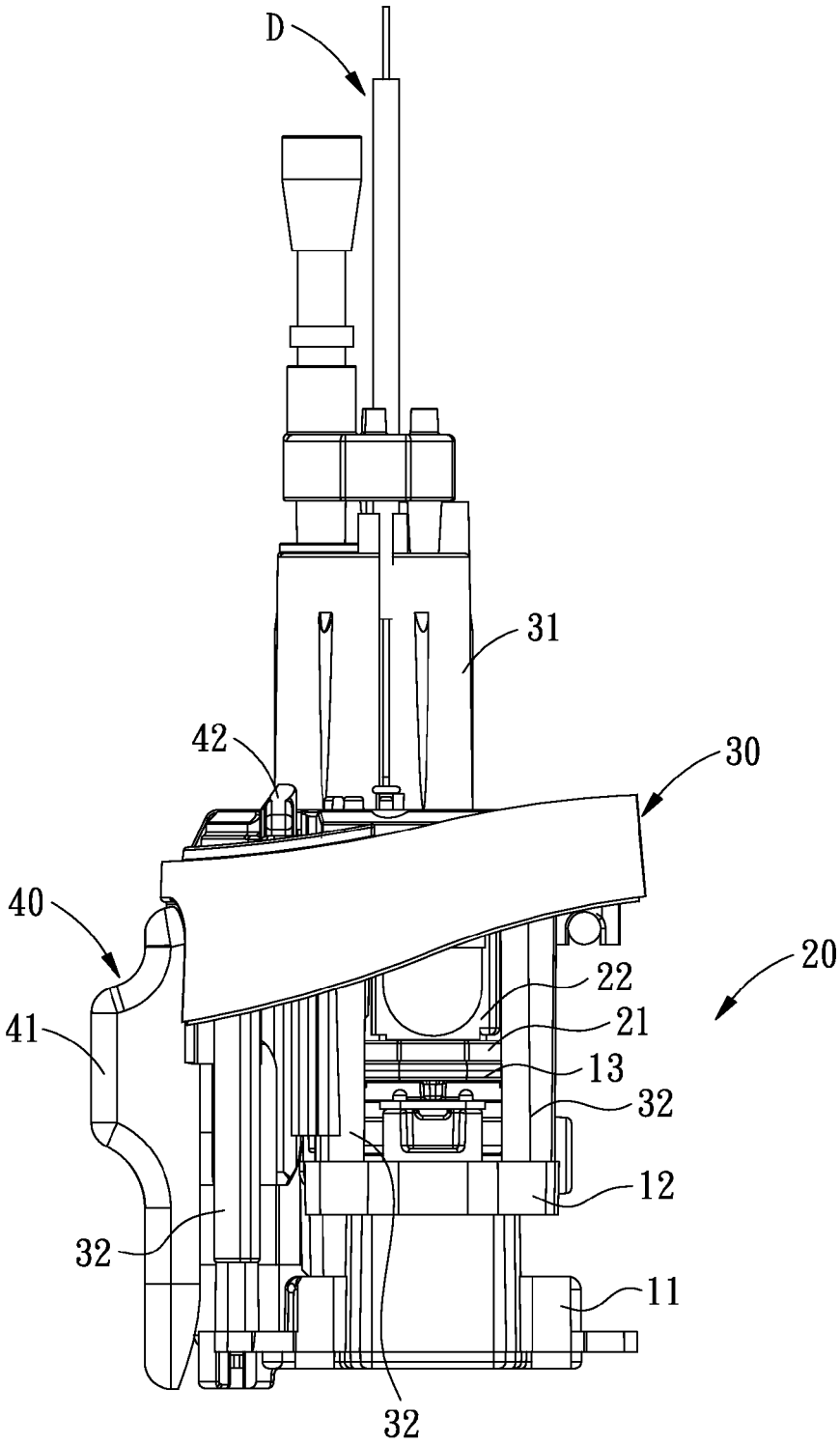
FIG. 8 is an illustrative view showing the assembly of the heater, the control member and the middle connecting member of the dual gas and AC electric hair styler in accordance with the present invention.
Figure 9:
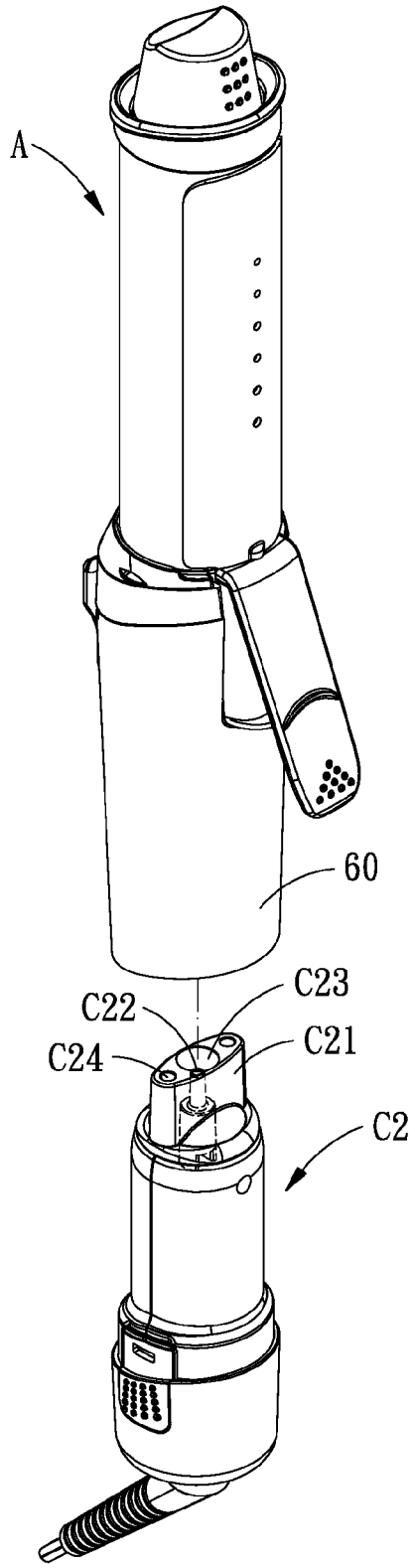
FIG. 9 shows that the dual gas and AC electric hair styler in accordance with the present invention with an electric power supply.
Figure 10:
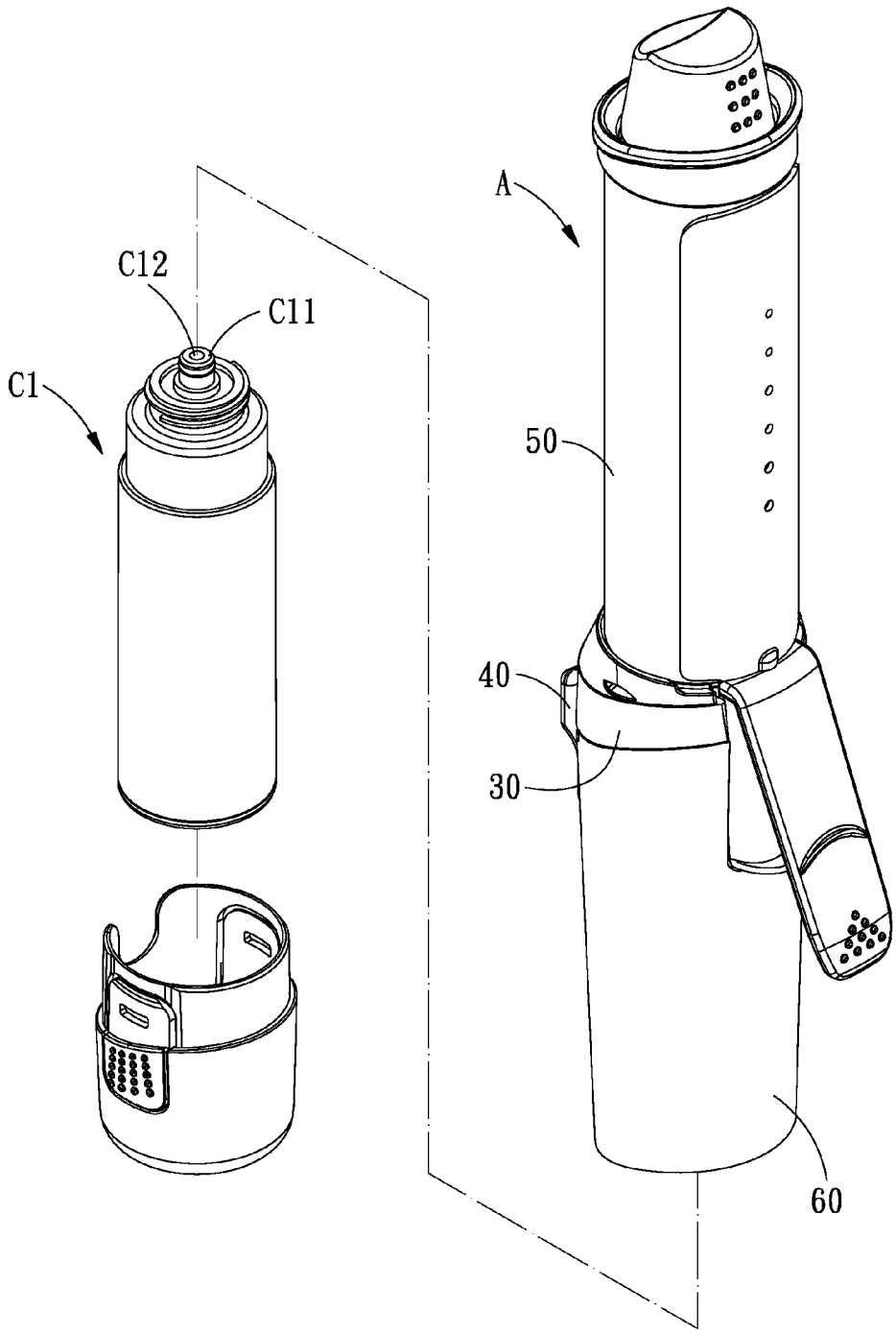
FIG. 10 shows that the dual gas and AC electric hair styler in accordance with the present invention with a gas supply.

The fixing member 21 has one end fixed to the second connecting member 13 of the base 10, and another end of the fixing member 21 is a hollow cylindrical abutting end 211 which extends in the X direction. Between the two ends of the fixing member 21 is defined an assembling space 212. An engaging groove 213 is formed at one side of the fixing member 21, and the abutting end 211 is formed with a connecting hole 214 connected to the second connecting member 13, and an ignition device D is to be disposed in the connecting hole 214, as shown in FIG. 8.

The elastic pressing member 22 includes a body portion 222, an actuating end 223 and an elastic pressing end 221 which are located at both ends of the body portion 222 and protrude in the X direction. The body portion 222 is received in the assembling space 212 of the fixing member 21 in such a manner that the elastic pressing end 221 of the elastic pressing member 22 extends out of the abutting end 211 of the fixing member 21, while the actuating end 223 is connected to the guiding member 23 which has a protruding guiding portion 231 inserted through the through hole 132 of the second connecting member 13 of the base 10. The spring 24 is biased between the elastic pressing end 221 of the elastic pressing member 22 and the housing A. By such arrangements, the linkage device 20 is elastically movable with respect to the housing A. Both sides of the elastic pressing member 22 are provided with a protruding portion 224 extending in a radial direction Y (which is vertical to the X direction).

The restriction member 25 is fixed at another side of the fixing member 21 opposite the engaging groove 213 and formed with a guiding hole 251 at each of two sides thereof. Each guiding hole 251 includes an X-directional extending portion 252 and a Y-directional extending portion 253 which is located at a far end of the guiding hole 251 with respect to the base 10.

The linking member 26 is a U-shaped elastic structure consisting of two opposite extending portions 261 and a middle portion 262 connected between the extending portions 261. The linking member 26 mounted on the fixing member 21 in such a manner that the middle portion 262 is received in the engaging groove 213 of the fixing member 21, while extending portions 261 extend above the assembling space 212 of the fixing member 21 and are abutted against one side of the protruding portions 224 facing the base 10 and are inserted in the guiding holes 251 of the restriction member 25.

The housing A comprises a middle member 30, a control member 40, a working-end shell 50 and an assembling-end shell 60.

The middle member 30 is mounted on and covers the fixing member 21 of the linkage device 20 and is provided at one end thereof close to the fixing member 21 with a hollow stopping portion 31 for accommodation of the elastic pressing member 22, moreover, the spring 24 which is mounted on the elastic pressing end 221 of the elastic pressing member 22 has one end pressed against the stopping portion 31. The middle member 30 is provided at another end thereof with a plurality of assembling portions 32 positioned against the middle connecting member 12 and the second connecting member 13, respectively.

The control member 40 is movably disposed in the housing A and connected to the linkage device 20 to control the electrical connection between the heater B and the gas supply C1 or electric power supply C2. The control member 40 includes a control portion 41 at one end and a linking portion 42 at another end thereof. The linking portion 42 is formed with two opposite linking grooves 421. The control portion 41 is exposed out of the middle member 30 of the housing A, the linking portion 42 is inserted in the middle member 30, and the linking member 26 is inserted through the guiding holes 251 of the restriction member 25 and into the linking grooves 421 of the control member 40, so that pushing the control member 40 can make the linking member 26 and the elastic pressing member 22 move.

The assembling-end shell 60 is connected to one end of the middle member 30 and covers the base 10 and the linkage device 20. A gas supply C1 or an electric power supply C2 is inserted in the assembling-end shell 60 toward the guiding member 23 or the electric connecting terminal 123.

The working-end shell 50 is connected to another end of the middle member 30. A hair-clasping device 70 is pivoted to the outer surface of the housing A and comprises a clasping piece 71 formed to fit the outer periphery of the housing A. pressing the hair-clasping device 70 can make the clasping piece 71 open and close with respect to the housing A.

The structural relationships of the respective parts of the dual gas and AC electric hair styler in accordance with the present invention are as mentioned above. In the use of the hair styler, hair is clasped between the clasping piece 71 and the housing A to be subjected to heating process. It is to be noted that the gas supply C1 and the electric power supply C2 each have a connecting end C11, C21. The connecting end C11 of the gas supply C1 is formed to fit the inner shape of the first connecting member 11, while the connecting end C21 of the electric power supply C2 is formed to fit the connecting groove 121 of the middle connecting member 12. The connecting end C11, C21 of the gas supply C1 and the electric power supply C2 each has a valve C12, C22 which can be pressed to affect electric connection by the guiding portion 231 inserted into the connecting portion 131.

The valve C12 of the gas supply C1 is provided at an end of the connecting end C11 and is to be inserted in the connecting portion 131, while the valve C22 of the electric power supply C2 is disposed in an engaging hole C23 of the connecting end C21. The engaging hole C23 has an inner diameter similar to the outer diameter of the connecting portion 131, so that the connecting portion 131 can fit right into the engaging hole C23 of the electric power supply C2. In the connecting end C21 of the electric power supply C2 are further defined two connecting ports C24.

To use a gas supply C1, the gas supply C1 should firstly be inserted in the housing A through the assembling-end shell 60, and the connecting end C11 of the gas supply C1 is inserted in the first connecting member 11 of the base 10 in such a manner that the valve C12 is inserted in the second connecting member 13 and located in front of the guiding portion 231 of the guiding member 23 without touching the guiding portion 231. At this moment, the heater B is not turned on yet.

Similarly, when the electric power supply C2 is to be used, the electric power supply C2 should firstly be inserted in the housing A through the assembling-end shell 60, and the connecting end C21 is inserted in the connecting groove 121 of the middle connecting member 12, while the connecting portion 131 of the second connecting member 13 is inserted in the engaging hole C23 of the electric power supply C2 in such a manner that the valve C22 is located in front of the guiding portion 231 of the guiding member 23 without touching the guiding portion 231, and the connecting ports C24 of the electric power supply C2 are aligned with the electric connecting terminals 123 of the middle connecting member 12. At this moment, the heater B is not turned on yet.

Figure 3:
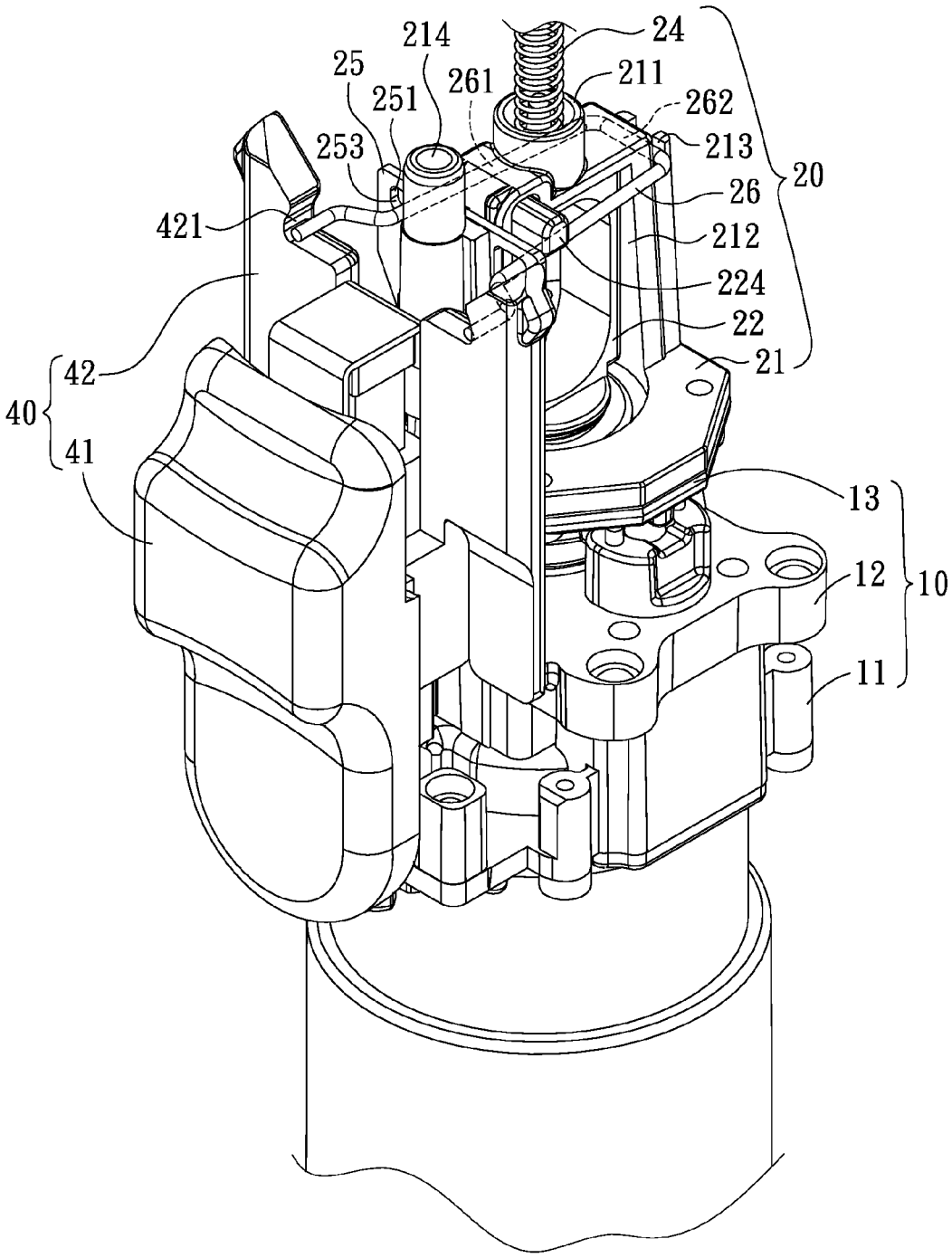
FIG. 3 is an enlarged view showing part of the dual gas and AC electric hair styler in accordance with the present invention.
Figure 4:
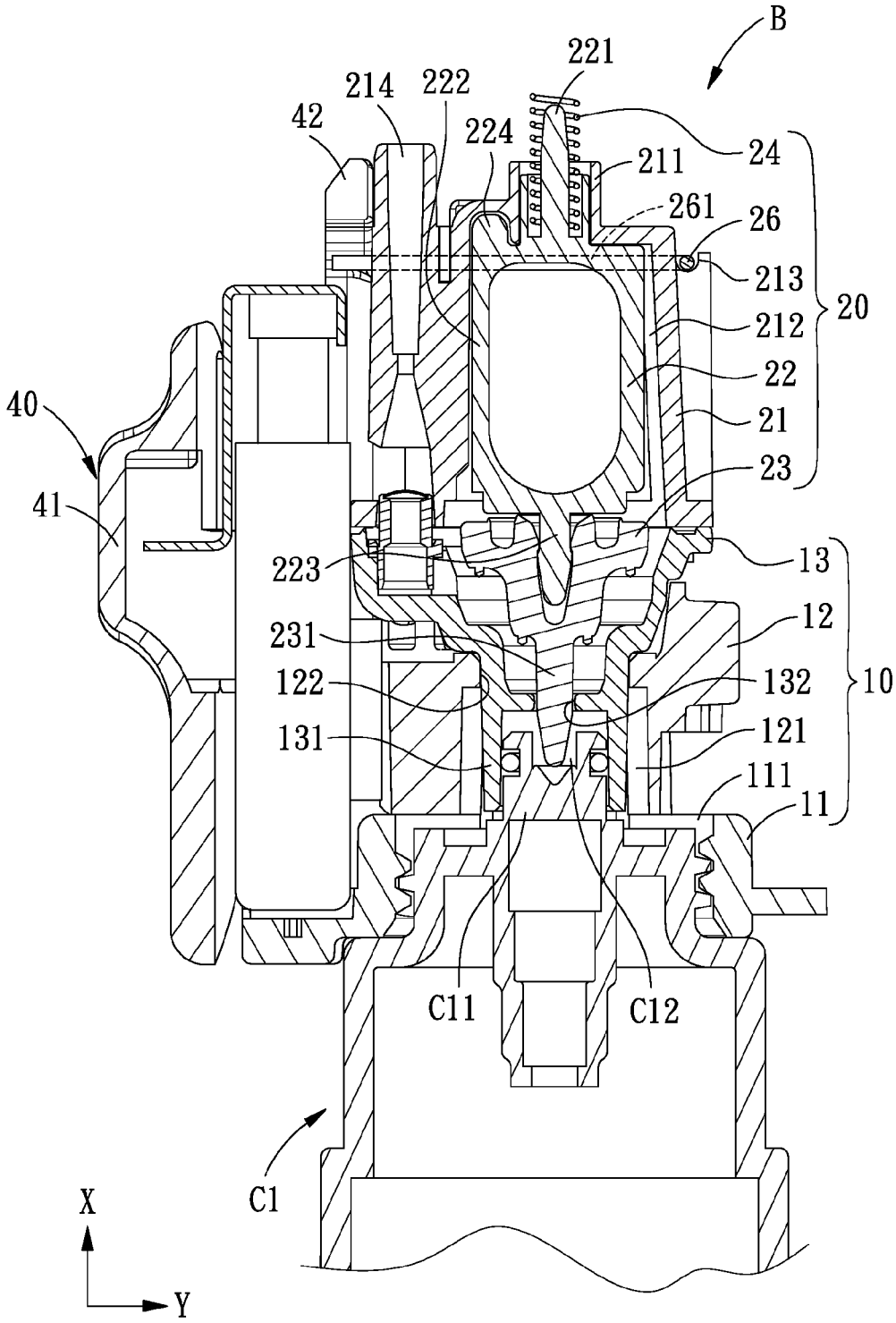
FIG. 4 is a cross sectional view showing a non-connected state of the heater of the dual gas and AC electric hair styler in accordance with the present invention.
Figure 5:
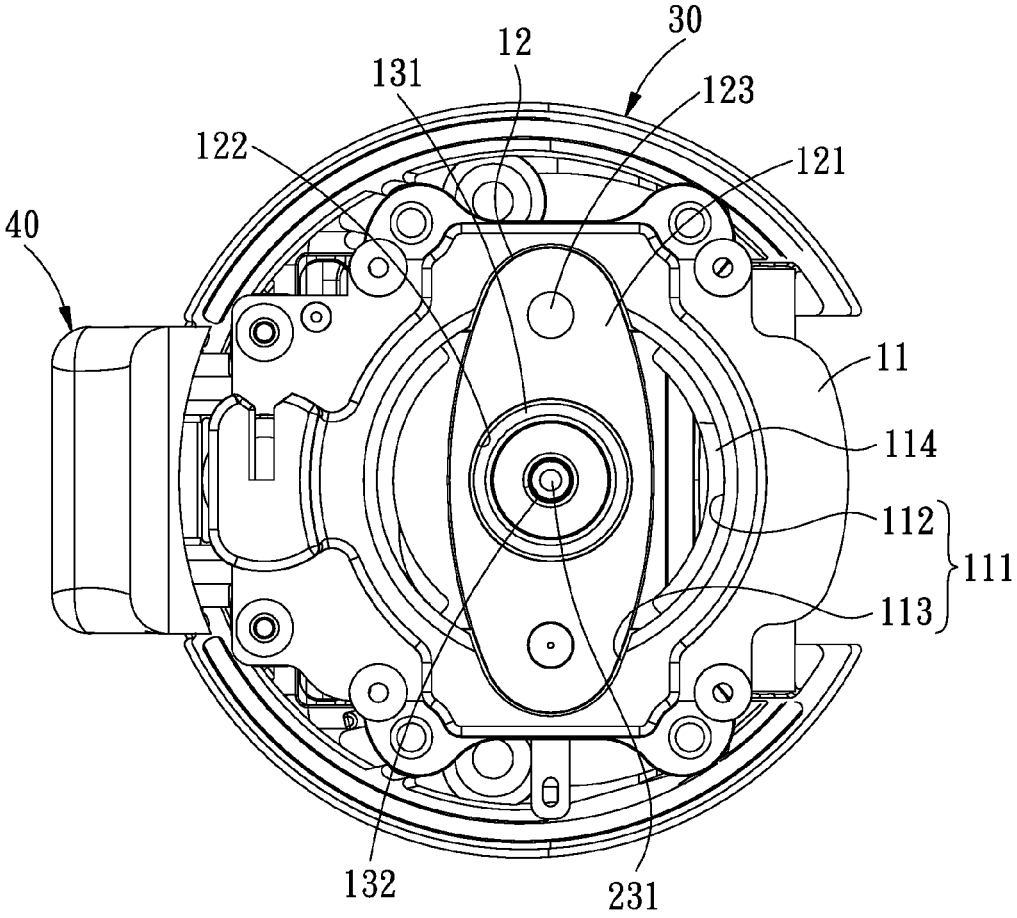
FIG. 5 is a bottom view of the heater of the dual gas and AC electric hair styler in accordance with the present invention.

The positional relation between the linkage device 20 and the control member 40 is as shown in FIGS. 3 and 4.

The extending portions 261 of the linking member 26 of the linkage device 20 is approximately horizontal, and the linking grooves 421 of the linking portion 42 of the control member 40 is located at the same level as the extending portions 261 which are received in extending portion 253 of the guiding holes 251 of the restriction member 25. Since the extending portion 253 extends in the radial direction Y, it can prevent the linking member 26 from moving in the axial direction X, meanwhile, the extending portions 261 push the protruding portion 224 to make the elastic pressing end 221 of the elastic pressing member 22 compress the spring 24.

Figure 6:
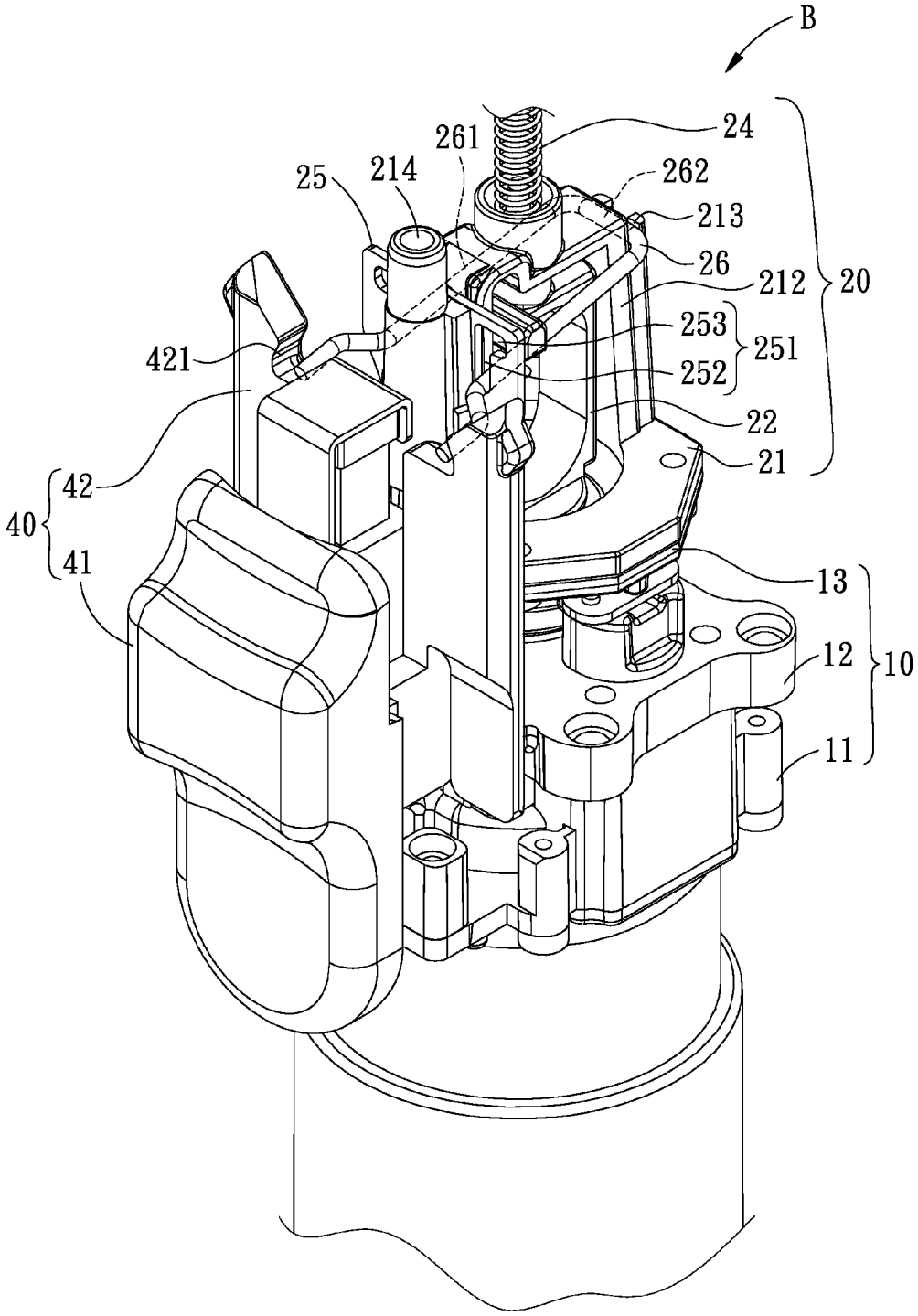
FIG. 6 is an enlarged view showing part of the dual gas and AC electric hair styler in accordance with the present invention.
Figure 7:
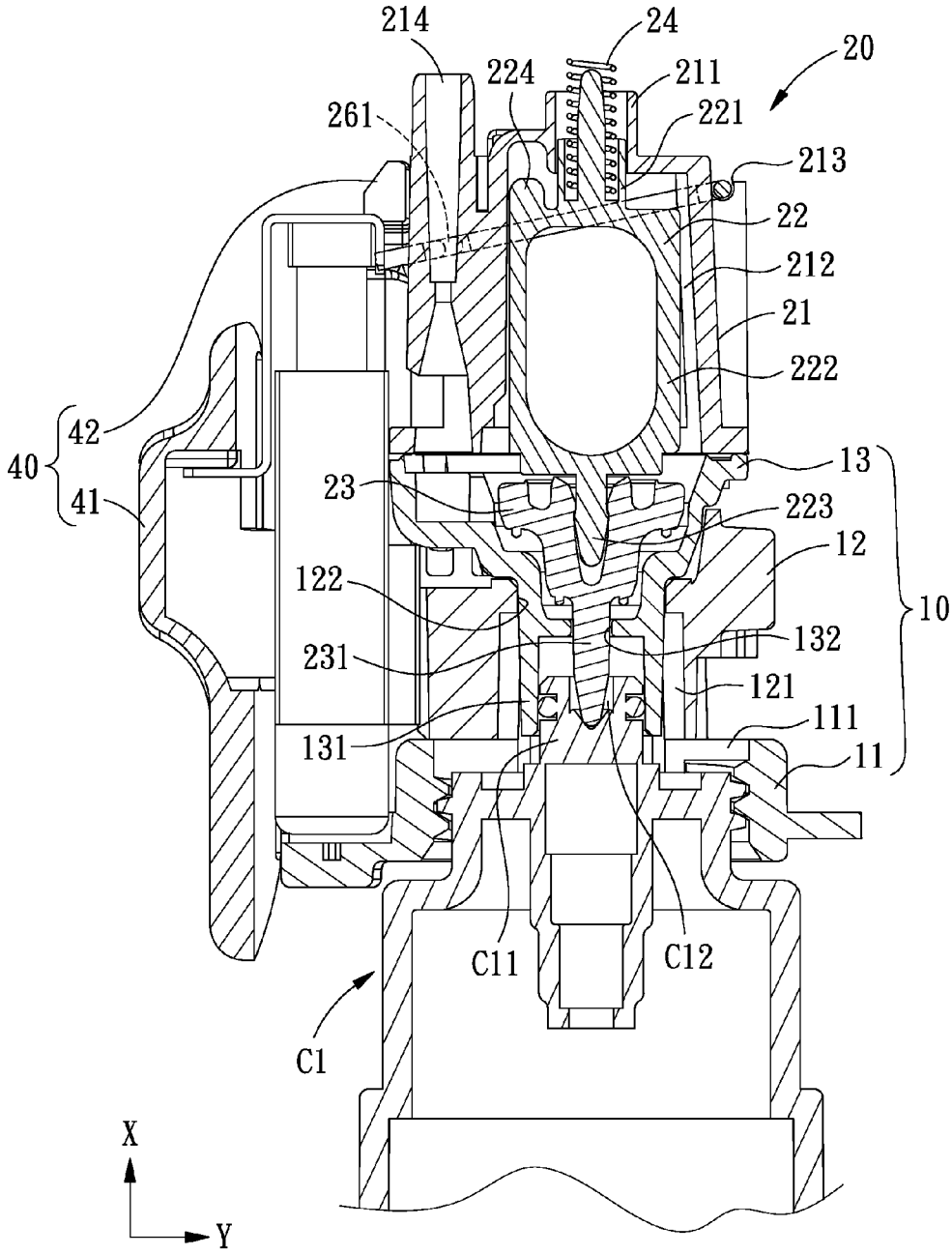
FIG. 7 is a cross sectional view showing the dual gas and AC electric hair styler in accordance with the present invention.

To turn on the heater B, the user only needs to pull the control portion 41 of the control member 40 toward the gas supply C1, meanwhile, the linking grooves 421 of the control member 40 also move toward the gas supply C1, at this moment, the linking member 26 stops pressing the elastic pressing member 22, and the spring 24 one the elastic pressing end 221 of the elastic pressing member 22 will be decompressed to push the elastic pressing member 22 toward the gas supply C1. Then, the guiding portion 231 of the guiding member 23 will be pushed by the elastic pressing member 22 into the valve C12 at the connecting end C11 of the gas supply C1 to enable the gas supply C1 to be connected to the heater B, and thus gas is supplied from the gas supply C1 to the heater B, as shown in FIGS. 6 and 7.

On the other hand, when the elastic pressing member 22 moves toward the gas supply C1, the protruding portions 224 of the elastic pressing member 22 will push the extending portions 261 of the linking member 26 out of the extending portion 253 of the guiding holes 251 of the restriction member 25 and into the X-directional extending portion 252, and thus, the heater B is turned on.

It is to be noted that the guiding member 23 works with the respective heater B and the control member 40, simply moving the control member 40 in the axial direction X can easily control the connection and disconnection between the guiding member 23 and the gas supply C1 and the electric power supply C2.

The operation of the electric power supply C2 is similar to that of the gas supply C1 except that the guiding portion 231 of the guiding member 23 correspondingly presses open the valve C22 of the electric power supply C2, while the electric connecting terminals 123 of the middle connecting member 12 are engaged in the connecting ports C24 of the electric power supply C2 to effect electric connection between the electric power supply C2 and the heater B, and thus turning on the heater B.

While we have shown and described various embodiments in accordance with the present invention, it is clear to those skilled in the art that further embodiments may be made without departing from the scope of the present invention.

What is claimed is:

1. A dual gas and AC electric hair styler comprising: a heater disposed in a housing, an extending direction of the housing being defined as an axial direction, a control member movably disposed in the housing in such a manner that one end of the control member is exposed out of the housing and another end of the control member is inserted in the housing to connect a linkage device of the heater, the linkage device including a guiding member, a gas supply and an electric power supply being selectively inserted in the housing, the gas supply and the electric power supply each having a valve which may be pressed to achieve a connection to the heater, wherein an axial movement of the control member causes axial movement of the linkage device and the guiding member to affect the connection of the gas supply or the electric power supply to the heater.

2. The dual gas and AC electric hair styler as claimed in claim 1, wherein a hair-clasping device is pivoted to an outer surface of the housing and comprises a clasping piece formed to fit the outer surface of the housing, pressing the hair-clasping device makes the clasping piece open and close with respect to the housing.

3. The dual gas and AC electric hair styler as claimed in claim 1, wherein the heater further comprises a base, the linkage device comprises a fixing member, an elastic pressing member, the guiding member, a spring, a restriction member and a linking member;

the fixing member has one end fixed to the base, between two ends of the fixing member is defined an assembling space, and an engaging groove is formed at one side of the fixing member;

the elastic pressing member includes a body portion, an actuating end and an elastic pressing end which are located at both ends of the body portion, and the elastic pressing end protrudes in the axial direction, the body portion is received in the assembling space of the fixing member in such a manner that the elastic pressing end of the elastic pressing member extends out of the fixing member, while the actuating end is connected to the guiding member which has a protruding guiding portion inserted through the base, the spring is biased between the elastic pressing end of the elastic pressing member and the housing, both sides of the elastic pressing member are provided with a protruding portion extending in an radial direction;

the restriction member is fixed at another side of the fixing member opposite the engaging groove and formed with a guiding hole at each of two sides thereof, each of the guiding holes includes an axial-directional extending portion and a radial-directional extending portion which is located at a far end of the guiding hole with respect to the base;

the linking member is a U-shaped elastic structure consisting of two opposite extending portions and a middle portion connected between the extending portions, the linking member mounted on the fixing member in such a manner that the middle portion is received in the engaging groove of the fixing member, while the extending portions are abutted against one side of the protruding portions facing the base and are inserted in the guiding holes of the restriction member;

the control member includes a control portion at one end and a linking portion at another end thereof, the linking portion is formed with two opposite linking grooves, the control portion is exposed out of the housing, and the linking member is inserted through the guiding holes of the restriction member and into the linking grooves of the control member.

4. The dual gas and AC electric hair styler as claimed in claim 3, wherein the housing comprises a middle member, a working-end shell and an assembling-end shell;

the middle member is mounted on and covers the fixing member of the linkage device, the assembling-end shell is connected to one end of the middle member and covers the base and the linkage device, the working-end shell is connected to another end of the middle member, the gas supply or the electric power supply is inserted in the assembling-end shell, the guiding member is inserted through the base toward the gas supply or the electric power supply, and the base is provided at its end facing the gas supply or the electric power supply with electric connecting terminals.

5. The dual gas and AC electric hair styler as claimed in claim 3, wherein the base comprises a first connecting member, a middle connecting member and a second connecting member;

the first connecting member comprises a gas connecting portion and two electric connecting portions connected at both ends of the gas connecting portion to define an assembling hole, at two opposite sides of the inner periphery of the gas connecting portion are formed two positioning portions;

the middle connecting member is abutted against the first connecting member and formed with a connecting groove in communication with the assembling hole of the first connecting member, in the connecting groove is further formed a hole located corresponding to the gas connecting portion, and an electric connecting terminal for each of the electric connecting portions;

the second connecting member is formed at one end thereof with a connecting portion which is hollow cylindrical and formed with a through hole, the second connecting member is mounted on the middle connecting member in such a manner that the connecting portion is inserted through the through hole of the connecting groove of the middle connecting member into the assembling hole of the first connecting member, the linkage device has one end fixed to the second connecting member of the base, and the guiding member is inserted through the through hole of the second connecting member of the base.

6. The dual gas and AC electric hair styler as claimed in claim 3, wherein a hollow cylindrical abutting end is formed at one end of the base, and the elastic pressing end of the elastic pressing member extends out of the abutting end of the fixing member.

7. The dual gas and AC electric hair styler as claimed in claim 6, wherein the abutting end is formed with a connecting hole connected to the second connecting member, and an ignition device is to be disposed in the connecting hole.

8. The dual gas and AC electric hair styler as claimed in claim 4, wherein the middle member is provided at one end thereof close to the fixing member with a hollow stopping portion for accommodation of the elastic pressing member, the spring which is mounted on the elastic pressing end of the elastic pressing member has one end pressed against the stopping portion, the middle member is provided at another end thereof with a plurality of assembling portions positioned against the middle connecting member and the second connecting member, respectively.

9. The dual gas and AC electric hair styler as claimed in claim 5, wherein the gas supply and the electric power supply each have a connecting end, the connecting end of the gas supply is formed to fit an inner shape of the first connecting member, while the connecting end of the electric power supply is formed to fit the connecting groove of the middle connecting member.

* * * * *